US006951040B2

(12) United States Patent
Müller

(10) Patent No.: US 6,951,040 B2
(45) Date of Patent: Oct. 4, 2005

(54) MULTIPLE FUNCTION TOOL

(76) Inventor: Hans Müller, Rua 13 de Maio 80, apto. 503, Petrópolis 25685-230, Rio de Janerio-RJ (BR)

( * ) Notice: Subject to any disclaimer, the term of this patent is extended or adjusted under 35 U.S.C. 154(b) by 7 days.

(21) Appl. No.: 10/433,222

(22) PCT Filed: Dec. 3, 2001

(86) PCT No.: PCT/BR01/00144

§ 371 (c)(1),
(2), (4) Date: Nov. 19, 2003

(87) PCT Pub. No.: WO02/45911

PCT Pub. Date: Jun. 13, 2002

(65) Prior Publication Data

US 2004/0064897 A1 Apr. 8, 2004

(30) Foreign Application Priority Data

Dec. 5, 2000 (BR) ..... 8002730 U

(51) Int. Cl.[7] ..... B26B 11/00
(52) U.S. Cl. ..... 7/162
(58) Field of Search ..... 7/118, 151, 156, 7/158, 162, 165; 30/123, 145

(56) References Cited

U.S. PATENT DOCUMENTS 994,119 A * 6/1911 Browning ..... 30/28
2,774,138 A * 12/1956 Gowdey ..... 30/28
3,042,047 A * 7/1962 Plaskon ..... 132/75.5
3,089,239 A * 5/1963 Loda ..... 30/142
3,261,094 A * 7/1966 Bliss ..... 30/143
3,825,961 A * 7/1974 Klein ..... 7/106
4,888,869 A 12/1989 Leatherman
5,666,728 A * 9/1997 Silva ..... 30/28

FOREIGN PATENT DOCUMENTS

GB 2 360 208 9/2001

OTHER PUBLICATIONS

International Search Report, PCT/BR01/00144, ISA/EPO, May 3, 2002.

* cited by examiner

*Primary Examiner*—Joseph J. Hail, III
*Assistant Examiner*—Bryan R Muller
(74) *Attorney, Agent, or Firm*—Harness, Dickey & Pierce, P.L.C.

(57) ABSTRACT

A multiple-function tool has two plates that are substantially parallel and symmetric to each other. Each plate has a first and second longitudinal extremity as well as being connected at an articulation forming a sharp angle. Second longitudinal extremities have concave edges with cutting blades forming a nail cutter device. Side extremities have convex edges adjacent to the concave edges and have projections sloping in relation to the plane of the plate and with a cooperating cutting blade thereby forming a cuticle cutter, a cuticle pusher, lifter and a nail cleaner.

17 Claims, 1 Drawing Sheet

MULTIPLE FUNCTION TOOL

The present invention refers to a tool with multiple functions, including the functions of cutting and cleaning cuticles and fingernails, allowing the users to have at their disposal a series of functions in a single, small-sized device.

DESCRIPTION OF THE STATE OF THE ART

Innumerable state of the art tools for cutting nails are known, the majority of these generally composed of two parallel plates joined by an articulation at one of its extremities, and, on the opposite end, two concave, symmetrical cutting blades. The blades are placed in such a way that, when one plate is pressed against the other, cutting occurs. However, all of these tools have one basic use, the cutting of nails or the cutting of cuticles, or, moreover, the cleaning of nails. None of the tools already known is suitable to perform all these functions together with the same part of the tool.

Document PI 9000406 describes a device for cutting nails that also has the function of cutting cuticles. This device comprises an "X" structure with two plates having two ends from which appendages project. One of the appendages has elements for cutting cuticles, and the other appendage has elements for cutting nails. It may be verified that this device has a relatively complex construction in order to allow the cutting of nails and cuticles.

U.S. Pat. No. 3,261,094 describes a multi-use tool that comprises a set consisting of a pocketknife and a cutter, stored in a case. This tool has two flexible parallel plates connected at a back wall, forming a transversal U-shaped section. Between these parallel plates, blades are provided allowing the performance of various additional functions: such as opening bottles, driving screws etc,. Besides these, there are concave, symmetrical blades, forming integral parts of the parallel plates, positioned in such a manner that the plates meet when the flexible parallel plates are pressed together. This tool, however, proves inefficient when the need to cut or remove cuticles, or, even, to clean nails arises, given that the blades of this tool do not have the right shape to perform these functions.

BRIEF DESCRIPTIONS OF THE INVENTION

The prime objective of the present invention consists of providing a tool with multiple functions, assembled in a device that is easy to handle and small in size.

Another objective of the present invention is to provide a cuticle cutter adjacent to a nail cutter, in such a way that, between both cutters, an angle of attack is formed that provides several different functions, such as to push and lift cuticles, as well as to clean under fingernails.

An additional objective of the present invention is to provide a tool with the functions of tweezers, a bottle opener, can opener, and screwdriver.

The present invention achieves these objectives as a tool with multiple functions, by having two elongated plates, substantially parallel and symmetric, each having a first and a second longitudinal extremity, as well as side extremities. The plates are connected by an articulation at the respective first longitudinal extremity, forming a sharp angle between them. The referred second longitudinal extremity has concave edges with inclined projections in relation to the plane of the plate, forming opposing cutting blades. Each time one plate is pressed against the other, the cutting of nails and cuticles is performed. The side extremities have convex edges with sloping projections in relation to the plane of the plate, forming opposing cutting blades. The concave edges of the longitudinal extremity are adjacent to the convex edge of the side extremity.

The referred concave edge and convex edge have an adjacent point, forming a vertex with an angle of attack. This angle of attack is used to push and lift cuticles and also to clean fingernails. The referred angle of attack is ideally approximately 40 degrees.

The-referred tool has, in one of its parallel plates, a first projection integrated with the plate and substantially in the same plane as the plate, this projection bearing an edge that executes the function of a screwdriver.

The referred parallel plates may also have side extremities with edges featuring projections sloping in relation to the plane of the plate. These sloping projections act, cooperating in such a manner as to form tweezers. One of the referred side edges may also have other projections associated to depressions in order to form a bottle opener.

The Multiple Function Tool comprises a shaft transversally disposed to the two parallel plates. This shaft has a retention surface at one of its extremities to hold one of the plates, and an articulated lever connected to the other extremity. The referred lever has a support point, which when pressed, causes flexions of both plates up and down. This mechanism may be the same as one used in the already existing state-of-the-art nail cutters.

Finally, the tool may also have, between the referred parallel plates, a variety of other plates able to perform different functions, such as a nailfile, knife, can opener etc.

BRIEF DESCRIPTION OF THE DRAWINGS

The present invention will next be described in more detail, based on an example of execution represented in the drawings. The figures show the following.

DETAILED DESCRIPTION OF THE FIGURES

Figure 1:
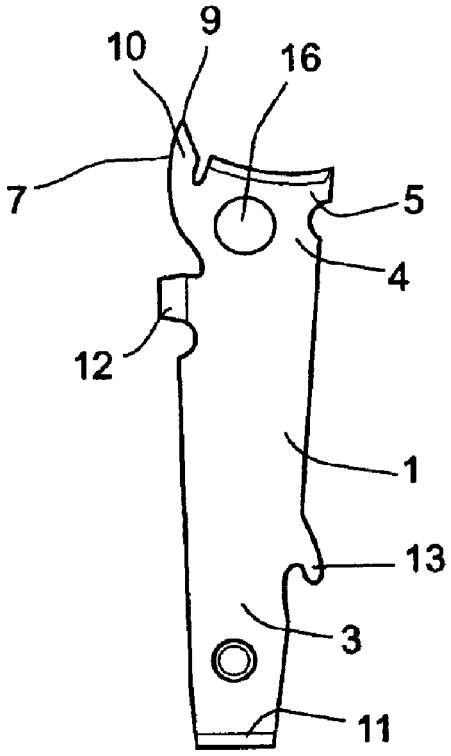
FIG. 1—An enlarged upper view of the multiple function tool, which is the object of the present invention.
Figure 2:
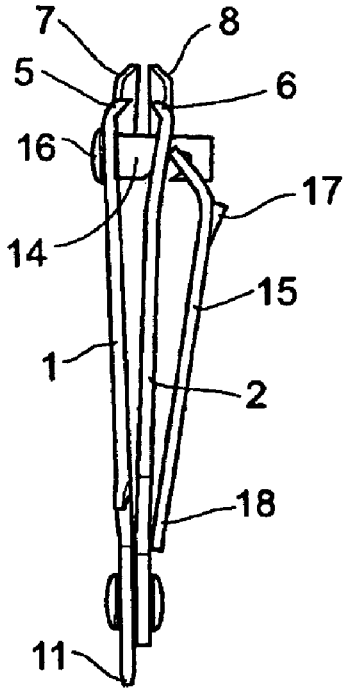
FIG. 2—An enlarged side view of the multiple function tool, which is the object of the present invention.

FIGS. 1 and 2 show a possible concretization of the multiple function tool of the present invention, consisting of two elongated plates (1, 2) substantially parallel and symmetric. Each plate has a first and a second longitudinal extremity (3, 4), as well as side extremities. The referred plates are connected by an articulation at the first longitudinal extremity, forming a sharp angle. In this concretization, the connection between the plates is made through a shaft. This connection may, however, also be made through any other means existing in the state of the art, for example, through a screw, a weld, among others, without limiting the scope of the present invention.

The referred second longitudinal extremity has concave edges (5, 6) with sloping projections in relation to the plane of the plate, forming cutting blades for the cutting of nails. This cutting of nails is performed each time that, one plate is pressed against the other plate. By the approximation of one blade with the other blade, the blades perform the cutting.

The side extremities have convex edges (7, 8) adjacent to the concave edges (5, 6) of the longitudinal extremity, with sloping projections in relation to the plane of the plate, forming cutting blades for the cutting of cuticles. This cutting of cuticles is performed when the blades are pressed together, by the same principle as the nail cutting blades.

The referred convex edges (7, 8) and the referred concave edges (5, 6), have an adjacent point where a vertex is formed, defining the angle of attack (9). The referred angle of attack (9) is used to push and lift cuticles, as well as to clean the under part of fingernails.

It should be noted that, although in the figure shown the angle of attack has its culminating vertex (10) formed by the outer edges of the referred convex edges (7, 8), it is evident to anyone versed in the art that the present invention maintains its functional characteristics with an angle of attack (9), as much using the projected concave edges (5, 6) as the convex edges (7, 8).

One of the referred parallel plates may also include on its first longitudinal extremity a projection in the plane of the plate, forming an edge that defines a screwdriver.

The referred side extremities may have edges with projections sloping in relation to the plane of the plate, and cooperating in such a way that, when pressing one plate against the other, it forms tweezers (12).

One of the referred side extremities may also have edges with projections associated to depressions, substantially in the plane of the plate, which form tools, in particular a bottle opener (13).

The edges of the extremities of the multi-function tool may also have other forms, providing new functions, without, however, limiting the scope of the present invention.

The multiple function tool of the present invention also includes a shaft (14), disposed transversely in the region close to the second extremity of the plates. This shaft has a retention head (16) formed at one of the shaft's extremities in order to hold the parallel plate (1) fixed to it. An articulated lever (15) is connected at the opposite extremity of this same shaft (14). This lever is connected to shaft (14) through a notch in this shaft. The lever (15) has a bend with support point (17) exactly at the mid-point of the outer part of the bend, close to shaft (14). This support point (17), when region (18) of the lever is pressed, exerts a force on parallel plate (2). As this lever (15) is connected to shaft (14), the lever, in pressing the support point (17) forces parallel plate (2) to move in relation to the length of shaft (14), also making parallel plate (1), supported by retention surface (16) of the shaft, to meet the opposite pressed parallel plate (2). This mechanism of bringing the plates together may be similar to any one utilized by a nail cutter or nipper in the state of the art.

Figure 3:
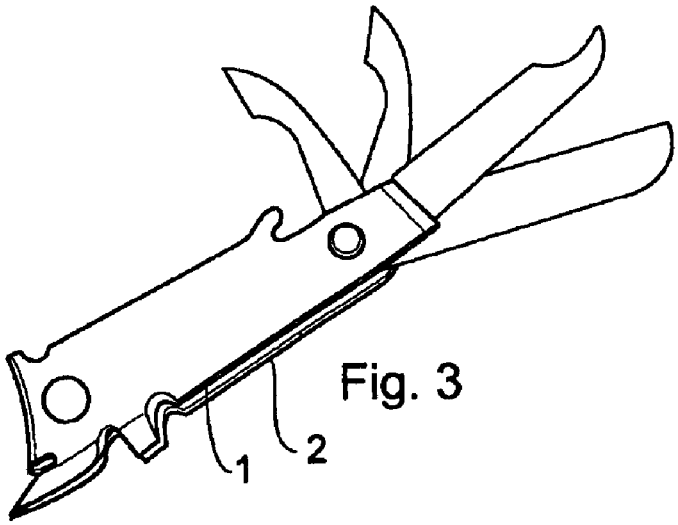
FIG. 3—An enlarged perspective view of some alternative options for the multiple function tool, which is the object of the present invention.

In addition, the multiple function tool of the present invention may include other possible concretizations, for example, the ones shown in FIG. 3, where there are plates disposed in parallel between the elongated plates (1, 2). There plates are connected at the first extremity through an articulation in a plane parallel to that of the plate. These plates may include, knives, files, can openers or any other tools of appropriate size in order to fill the space between the referred parallel plates.

Having been described through the examples of preferred concretizations of the present invention, it should be understood, as mentioned above, that the scope of the present invention includes other possible variations, limited only by the content of the claims.

What is claimed is:

1. A multiple function tool comprising:

two elongated plates substantially parallel and symmetric, each having a first and a second longitudinal extremity, as well as side extremities, the plates are connected at an articulation at the respective first longitudinal extremity, forming a sharp angle between them;

the second longitudinal extremity has concave edges with projections sloping in relation to the plane of the plate, which form cutting blades in such a way that when pressing one plate against the other, these blades are brought together in order to perform the cutting of an object, especially nails;

the side extremity has convex edges with projections sloping in relation to the plane of the plate, forming two other cooperating cutting blades, especially for cuticles;

the tool is characterized by the fact that the second longitudinal extremities have a first and a second part, the first having concave edges with the culling blades, and the second being adjacent to the convex edges to form a vertex portion with an angle of attack to push and lift cuticles, as well as to clean the under part of the finger nails, wherein, when pressing one plate against the other, the only contact in the vertex portion takes place along the convex edges; and the second longitudinal extremities include parallel and symmetric slots separating said first from said second part.

2. The multiple function tool, according to claim 1, is characterized by the fact that the side extremity has edges with a projection sloping in relation to the plane of the plate, cooperating in such a way that the edges form tweezers.

3. The multiple function tool, according to claim 1, is characterized by the fact that the angle of attack defined by outer edges of the convex edges is approximately 40 degrees.

4. The multiple function tool, according to claim 1, is characterized by the fact that one of the referred parallel plates has in its first extremity a projection in the plane of the plate with an edge forming a screwdriver.

5. The multiple function tool, according to claim 1, is characterized by the fact that one of the side extremities has edges with projections associated to depressions, substantially in the plane of the plate, in such a way as to form a tool, in particular a bottle opener.

6. The multiple function tool, according to claim 1, is characterized by the fact that it also includes:

one shaft transversally disposed in the region close to the second extremity of the plates, featuring a retention head at one of its extremities to support one of the plates; and one articulated lever connected at the other extremity of the shaft through a notch close at the articulation point, wherein a bend in the lever features a support point, which when the lever is pressed down in relation to shaft, allows the support point to press the plate, making the latter move in relation to shaft, and forcing one plate to meet the other supported by the retention surface.

7. The multiple function tool, according to claim 1, is characterized by the fact that it includes at least a third plate, disposed in parallel between the referred parallel plates and connected to its first extremity through an articulation in a plane parallel to that of the plate.

8. The multiple function tool, according to claim 7, is characterized by the fact that the third plate includes a knife.

9. A multiple function tool comprising:

two elongated plates (1, 2) substantially parallel and symmetric, each having a first (3) and a second (4) longitudinal extremity, as well as side extremities, the said plates (1,2) being connected at an articulation at the respective first longitudinal extremity, forming a sharp angle between them;

the second longitudinal extremity (4) having concave edges (5, 6) with projections sloping in relation to the plane of the plates (1,2), forming cutting blades in such a way that when pressing one plate against the other, these blades are brought together in order to perform the cutting of an object, especially nails;

the side extremity having convex edges (7, 8) with projections sloping in relation to the plane of the plates (1,2), forming two other cooperating cutting blades, especially for cuticles;

the second longitudinal extremities (4) of the tool having a first and a second part, the first part having said concave edges (5, 6) with cutting blades, and the second part forming a vertex portion (10) having said convex edges (7,8) with cutting blades facing to the opposite direction of the said first part, wherein, when pressing the said plates (1,2) one against the other, the only contact in the said vertex portion (10) taking place along the said convex edges (7,8); and the second longitudinal extremities (4) including parallel and symmetric slots separating said first from said second part.

10. The multiple function tool, according to claim 9, also comprising:

one shaft (14) transversally disposed in the region close to the second extremity (4) of the plates (1,2), featuring a retention head (16) at one of its extremities to support one of the plates (1); and one articulated lever (15) connected at the other extremity of the shaft (14) through a notch close at the articulation point, the lever (15) presenting a bend with a support point (17) at the midpoint of the outer part of the bend close to the shaft (14), thereby when pressing down the lever (15) in relation to the shaft (14), the support point (17) presses the plate (2), making the latter move in relation to shaft (14), and forcing one plate to meet the other supported by the retention surface (16).

11. The multiple function tool, according to claim 9, in which the culminating vertex (10) of the angle of the attack (9) is formed by the outer edges of the convex edges (7,8).

12. The multiple function tool, according to claim 11, in which the angle of attack (9) is approximately 40 degrees.

13. The multiple function tool, according to claim 9, in which the one of the referred parallel plates has in its first extremity (3) a projection in the plane of the plate with an edge forming a screwdriver (11).

14. The multiple function tool, according to claim 9, in which the side extremities have edges with a projections sloping in relation to the plane of the plates (1,2), cooperating in such a way that the edges form tweezers (12).

15. The multiple function tool, according to claim 9, in which one of the side extremities has edges with projections associated to depressions, substantially in the plane of the plate, in such a way as to form a tool, in particular a bottle opener (13).

16. The multiple function tool, according to claim 9, in which it includes at least a third plate, disposed in parallel between the referred parallel plates (1,2) and connected to its first extremity (3) through an articulation in a plane parallel to that of the plates (1,2).

17. The multiple function tool, according to claim 16, in which the third plate includes a knife.

* * * * *